US011596036B2

(12) United States Patent
Sun et al.

(10) Patent No.: US 11,596,036 B2
(45) Date of Patent: Feb. 28, 2023

(54) ILLUMINATION APPARATUS, ILLUMINATION SYSTEM, AND ILLUMINATION CONTROL METHOD

(71) Applicant: ELO TOUCH SOLUTIONS, INC., Milpitas, CA (US)

(72) Inventors: Yin Sun, Shanghai (CN); Haolai Zhou, Shanghai (CN); Hua Shao, Shanghai (CN)

(73) Assignee: ELO TOUCH SOLUTIONS, INC., Knoxville, TN (US)

( * ) Notice: Subject to any disclaimer, the term of this patent is extended or adjusted under 35 U.S.C. 154(b) by 0 days.

(21) Appl. No.: 17/369,334

(22) Filed: Jul. 7, 2021

(65) Prior Publication Data

US 2022/0015205 A1 Jan. 13, 2022

(30) Foreign Application Priority Data

Jul. 8, 2020 (CN) ..... 202010652616.2

(51) Int. Cl.
*F21V 23/06* (2006.01)
*H05B 45/24* (2020.01)
(Continued)

(52) U.S. Cl.
CPC ..... *H05B 45/24* (2020.01); *F21V 23/06* (2013.01); *F21Y 2113/10* (2016.08); *F21Y 2115/10* (2016.08)

(58) Field of Classification Search
CPC ..... F21Y 2113/10; F21Y 2115/10
See application file for complete search history.

(56) References Cited

U.S. PATENT DOCUMENTS 7,985,137 B1 * 7/2011 Klitsner ..... A63F 9/24 463/31
2004/0114359 A1 * 6/2004 Parsons ..... F21L 4/005 362/200

(Continued)

FOREIGN PATENT DOCUMENTS

EP 1096445 A2 5/2001

OTHER PUBLICATIONS

International Search Report and Written Opinion dated Oct. 27, 2020 in International Application PCT/US2020/045488; 34 pages.

(Continued)

*Primary Examiner* — Evan P Dzierzynski
(74) *Attorney, Agent, or Firm* — Sterne, Kessler, Goldstein & Fox P.L.L.C.

(57) ABSTRACT

The present disclosure relates to an illumination apparatus, an illumination system and an illumination control method. The illumination apparatus comprises: a first light emitting assembly configured to generate a first radiated light having a first color temperature and a first light intensity, wherein the first light intensity is adjustable; a second light emitting assembly configured to generate a second radiated light having a second color temperature and a second light intensity, wherein the second light intensity is adjustable and the second color temperature is lower than the first color temperature; and a third light emitting assembly configured to generate a third radiated light having a preset color and a third light intensity, wherein the preset color and the third light intensity are adjustable; wherein a color temperature of a radiated light generated by the illumination apparatus is configured to be adjusted by adjusting at least one of the first light intensity and the second light intensity.

20 Claims, 2 Drawing Sheets

(51) Int. Cl.
*F21Y 113/10* (2016.01)
*F21Y 115/10* (2016.01)

(56) References Cited

U.S. PATENT DOCUMENTS

| | | | | |
|---|---|---|---|---|
| 2008/0126440 | A1 | 5/2008 | Dryfoos et al. | |
| 2008/0163172 | A1 | 7/2008 | Rossmann et al. | |
| 2011/0093516 | A1 | 4/2011 | Geng et al. | |
| 2011/0113421 | A1 | 5/2011 | Ewington et al. | |
| 2012/0086338 | A1* | 4/2012 | Kim | H05B 45/10 315/86 |
| 2017/0031620 | A1 | 2/2017 | Yu et al. | |
| 2018/0048473 | A1 | 2/2018 | Miller et al. | |
| 2018/0203683 | A1 | 7/2018 | Kim | |
| 2019/0057214 | A1 | 2/2019 | Xia et al. | |
| 2019/0191534 | A1* | 6/2019 | De Bruycker | H02J 9/061 |
| 2020/0084867 | A1* | 3/2020 | Yadav | H05B 47/19 |
| 2021/0240466 | A1 | 8/2021 | Sun et al. | |

OTHER PUBLICATIONS

International Preliminary Report on Patentability directed to related International Patent Application No. PCT/US2020/045488, dated Feb. 8, 2022; 13 pages.

Supplementary Partial European Search Report and Provisional Opinion directed to related European Patent Application No. 20839212.6, completed Mar. 22, 2022; 13 pages.

Extended European Search Report directed to related European Patent Application No. 20839212.6, dated Jul. 25, 2022; 18 pages.

* cited by examiner

ILLUMINATION APPARATUS, ILLUMINATION SYSTEM, AND ILLUMINATION CONTROL METHOD

CROSS REFERENCE TO RELATED APPLICATION

The present disclosure claims the benefit of CN Application No. 202010652616.2, filed Jul. 8, 2020, titled "Illumination Apparatus, Illumination System, And Illumination Control Method", the content of which is hereby incorporated by reference in its entirety.

TECHNICAL FIELD

The present disclosure relates to the field of illumination technologies, and in particular, to an illumination apparatus, an illumination system, and an illumination control method.

BACKGROUND

With the development of technologies, the demands for illumination are also increasing accordingly. For example, in the case of automatic recognition of an object, it is necessary to control various parameters of a radiated light for illumination within a certain range in order to improve efficiency, accuracy, and etc. of the recognition, and thus there is a demand for an illumination apparatus that generates the radiated light whose parameters are adjustable.

SUMMARY

One of the objectives of the present disclosure is to provide an illumination apparatus, an illumination system, and an illumination control method.

According to a first aspect of the present disclosure, there is provided an illumination apparatus comprising:

a first light emitting assembly configured to generate a first radiated light having a first color temperature and a first light intensity, wherein the first light intensity is adjustable;

a second light emitting assembly configured to generate a second radiated light having a second color temperature and a second light intensity, wherein the second light intensity is adjustable and the second color temperature is lower than the first color temperature; and a third light emitting assembly configured to generate a third radiated light having a preset color and a third light intensity, wherein the preset color and the third light intensity are adjustable:

wherein a color temperature of a radiated light generated by the illumination apparatus is configured to be adjusted by adjusting at least one of the first light intensity and the second light intensity.

In some embodiments, the apparatus further comprises:

one or more input ports each configured to receive a respective input signal; and an output port electrically connected with at least one of the one or more input ports and configured to output an output signal, wherein the output signal comprises at least a portion of an input signal received by an input port electrically connected with the output port.

In some embodiments, the output port is configured to be electrically connected with at least one input port of another illumination apparatus.

In some embodiments, the one or more input ports comprise a third input port electrically connected with the output port and configured to receive a color instruction signal corresponding to the preset color; and the output port is configured to output the color instruction signal as the output signal.

In some embodiments, the third input port is further electrically connected with the third light emitting assembly; and the third light emitting assembly is configured to generate the third radiated light having the preset color according to the color instruction signal.

In some embodiments, the third input port is further configured to receive a third power supply signal corresponding to the third light intensity; and the third light emitting assembly is configured to generate the third radiated light having the third light intensity according to the third power supply signal.

In some embodiments, the third power supply signal is a third direct current signal.

In some embodiments, the apparatus further comprises:

a first controller electrically connected with the third input port and configured to receive the color instruction signal and convert the color instruction signal into a color controlling signal; and a driver electrically connected between the first controller and the third light emitting assembly and configured to receive the color controlling signal, convert the color controlling signal into a color driving signal, and transmit the color driving signal to the third light emitting assembly.

In some embodiments, the first controller is further configured to relay the color instruction signal to the output port.

In some embodiments, the first controller is configured to periodically control, at a preset frequency, the driver to drive the third light emitting assembly.

In some embodiments, the first controller comprises a micro control unit.

In some embodiments, the one or more input ports comprise a first input port electrically connected with the first light emitting assembly and configured to receive a first power supply signal corresponding to the first light intensity;

the first light emitting assembly is configured to generate the first radiated light having the first light intensity according to the first power supply signal.

In some embodiments, the first power supply signal is a first direct current signal.

In some embodiments, the one or more input ports comprise a second input port electrically connected with the second light emitting assembly and configured to receive a second power supply signal corresponding to the second light intensity;

the second light emitting assembly is configured to generate the second radiated light having the second light intensity according to the second power supply signal.

In some embodiments, the second power supply signal is a second direct current signal.

In some embodiments, the first light emitting assembly comprises a plurality of first light emitting diodes connected in parallel configured to generate a first white light having the first color temperature.

In some embodiments, the second light emitting assembly comprises a plurality of second light emitting diodes connected in parallel configured to generate a second white light having the second color temperature.

In some embodiments, the third light emitting assembly comprises a plurality of third light emitting devices connected in parallel configured to generate a chromatic light.

In some embodiments, the third light emitting device comprises:

at least one third light emitting diode, wherein the third light emitting diode is configured to generate a red light;

at least one fourth light emitting diode, wherein the fourth light emitting diode is configured to generate a green light; and at least one fifth light emitting diode, wherein the fifth light emitting diode is configured to generate a blue light.

In some embodiments, the first light emitting assembly and the second light emitting assembly are configured for illumination; and the third light emitting assembly is configured to indicate current status information.

According to a second aspect of the present disclosure, there is provided an illumination system comprising:

the illumination apparatus as described above;

a power supply apparatus electrically connected with the illumination apparatus and configured to provide a power supply signal to the illumination apparatus; and a second controller electrically connected with the illumination apparatus and the power supply apparatus and configured to adjust at least one of the first light intensity, the second light intensity, the third light intensity, and the preset color.

In some embodiments, the second controller is configured to receive a command signal and adjust at least one of the first light intensity, the second light intensity, the third light intensity, and the preset color according to the command signal.

In some embodiments, the second controller is configured to receive a sensing signal and adjust at least one of the first light intensity, the second light intensity, the third light intensity, and the preset color according to the sensing signal;

wherein the sensing signal is related to at least one of light intensity, color temperature and color of the radiated light generated by the illumination apparatus.

In some embodiments, the power supply apparatus comprises:

a power supply assembly configured to generate a direct current power supply signal having a preset level;

a conversion assembly electrically connected with the power supply assembly and configured to convert the direct current power supply signal into a first power supply signal for supplying the first light emitting assembly, a second power supply signal for supplying the second light emitting assembly, a third power supply signal for supplying the third light emitting assembly, and a control power supply signal for supplying the second controller.

In some embodiments, the conversion assembly further comprises a sampling circuit configured to sample the first power supply signal, the second power supply signal, and the third power supply signal to generate a sampled signal and to transmit the sampled signal to the second controller.

In some embodiments, the second controller is configured to control the conversion assembly to control at least one of the first power supply signal, the second power supply signal, and the third power supply signal according to the sampled signal.

According to a third aspect of the present disclosure, there is provided an illumination control method used for controlling the illumination apparatus as described above, comprising:

receiving an illumination control instruction;

generating a light emitting driving signal according to the illumination control instruction, wherein the light emitting driving signal comprises a first power supply signal for supplying the first light emitting assembly, a second power supply signal for supplying the second light emitting assembly, and a third power supply signal and a color driving signal for supplying the third light emitting assembly; and driving the illumination apparatus to generate a radiated light according to the light emitting driving signal, wherein the radiated light comprises the first radiated light generated by the first light emitting assembly driven by the first power supply signal, the second radiated light generated by the second light emitting assembly driven by the second power supply signal, and the third radiated light generated by the third light emitting assembly driven by the third power supply signal and the color driving signal.

In some embodiments, the method further comprises:

acquiring a color instruction signal according to the illumination control instruction; and relaying the color instruction signal to another illumination apparatus:

wherein the color instruction signal corresponds to the color driving signal.

In some embodiments, the method further comprises:

generating and outputting a feedback signal according to a current state of the illumination apparatus.

In some embodiments, after receiving the illumination control instruction, the method further comprises:

judging whether the illumination control instruction coincides with a preset check rule;

when the illumination control instruction does not coincide with the preset check rule, generating and outputting an error signal; and when the illumination control instruction coincides with the preset check rule, generating the light emitting driving signal according to the illumination control instruction, or driving the illumination apparatus to generate the radiated light according to the light emitting driving signal.

In some embodiments, prior to receiving the illumination control instruction, the method further comprises:

acquiring a default illumination control instruction; and controlling the illumination apparatus to generate a default radiated light according to the default illumination control instruction.

In some embodiments, the method further comprises:

accumulating a driving duration of the light emitting driving signal; and when the driving duration is longer than or equal to a preset duration, recontrolling the illumination apparatus to generate the radiated light according to the illumination control instruction.

Other features of the present disclosure and advantages thereof will become more apparent from the following detailed description of exemplary embodiments thereof, which proceeds with reference to the accompanying drawings.

BRIEF DESCRIPTION OF THE DRAWINGS

The accompanying drawings, which constitute a part of the specification, illustrate embodiments of the present disclosure and, together with the description, serve to explain the principles of the present disclosure.

The present disclosure will be better understood according the following detailed description with reference of the accompanying drawings, wherein.

Figure 1:
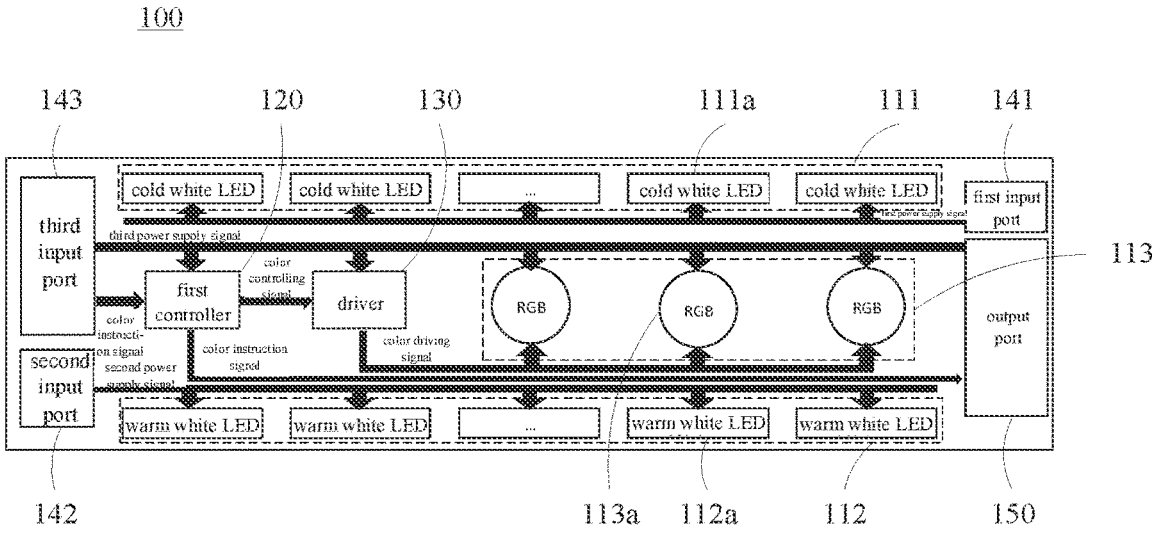
FIG. 1 shows a structure schematic diagram of an illumination apparatus according to an exemplary embodiment of the present disclosure.

Note that, in the embodiments described below, in some cases the same portions or portions having similar functions are denoted by the same reference numerals in different drawings, and description of such portions is not repeated. In some cases, similar reference numerals and letters are used to refer to similar items, and thus once an item is defined in one figure, it need not be further discussed for following figures.

In order to facilitate understanding, the position, the size, the range, or the like of each structure illustrated in the drawings and the like are not accurately represented in some cases. Thus, the disclosure is not necessarily limited to the position, size, range, or the like as disclosed in the drawings and the like. The arrows represent signal flows.

DETAILED DESCRIPTION

Various exemplary embodiments of the present disclosure will be described in details with reference to the accompanying drawings in the following. It should be noted that the relative arrangement of the components and steps, the numerical expressions, and numerical values set forth in these embodiments do not limit the scope of the present disclosure unless it is specifically stated otherwise.

The following description of at least one exemplary embodiment is merely illustrative in nature and is in no way intended to limit this disclosure, its application, or uses. That is to say, the structure and method discussed herein are illustrated by way of example to explain different embodiments according to the present disclosure. It should be understood by those skilled in the art that, these examples, while indicating the implementations of the present disclosure, are given by way of illustration only, but not in an exhaustive way. In addition, the drawings are not necessarily drawn to scale, and some features may be enlarged to show details of some specific components.

Techniques, methods and apparatus as known by one of ordinary skill in the relevant art may not be discussed in detail, but are intended to be regarded as a part of the specification where appropriate.

In all of the examples as illustrated and discussed herein, any specific values should be interpreted to be illustrative only and non-limiting. Thus, other examples of the exemplary embodiments could have different values.

In an exemplary embodiment of the present disclosure, an illumination apparatus is proposed. As shown in FIG. 1, the illumination apparatus 100 may include a first light emitting assembly 111 and a second light emitting assembly 112. The first light emitting assembly III and the second light emitting assembly 112 may be configured for illumination, e.g. providing a white light to illuminate an object to be recognized, etc.

In some embodiments, the first light emitting assembly 111 may be configured to generate a first radiated light having a first color temperature and a first light intensity, and the second light emitting assembly 112 may be configured to generate a second radiated light having a second color temperature and a second light intensity, wherein the second color temperature is lower than the first color temperature. The first color temperature and the second color temperature may be determined by properties (including light emitting principle, light emitting material, etc.) of the first light emitting assembly 111 and the second light emitting assembly 112, respectively. Further, the first light intensity and the second light intensity can be changed, and specifically, the first light intensity and the second light intensity can be adjusted by adjusting a first power supply signal applied to the first light emitting assembly 111 and a second power supply signal applied to the second light emitting assembly 112, respectively. Accordingly, the color temperature of the radiated light generated by the illumination apparatus 100 may be configured to be adjusted by adjusting at least one of the first light intensity and the second light intensity. That is, by varying a relative proportion of the first radiated light with respect to the second radiated light, i.e., by varying a relative magnitude between the first light intensity and the second light intensity, adjustment of the color temperature may be achieved. For example, when a lower color temperature is desired, a proportion of the first light intensity of the first radiated light in a total light intensity can be appropriately decreased or the first light emitting assembly 111 can be turned off, and similarly, when a higher color temperature is desired, the proportion of the first light intensity of the first radiated light in the total light intensity can be appropriately increased or the second light emitting assembly 112 can be turned off.

As shown in FIG. 1, the first light emitting assembly 111 may include a plurality of first light emitting diodes 111*a* (cold white LEDs shown in FIG. 1), and the first light emitting diode 111*a* may be configured to generate a first white light having a first color temperature. By providing a plurality of first light emitting diodes 111*a*, on the one hand, the first light intensity of the first radiated light generated by the first light emitting assembly 111 can be increased, and on the other hand, the position of each first light emitting diode 111*a* can be set to help realize a uniform distribution or other specific distributions of the first radiated light in space. In addition, the plurality of first light emitting diodes 111*a* may be connected in parallel, so that when a certain first light emitting diode 111*a* malfunctions, other first light emitting diodes 111*a* can still operate normally to ensure normal illumination as much as possible.

In some embodiments, the first light emitting diodes 111*a* may be disposed at an equal interval from each other, and uniformly distributed on the substrate to form a uniform lighting condition.

Similarly, the second light emitting assembly 112 may include a plurality of second light emitting diodes 112*a* (warm white LEDs shown in FIG. 1), and the second light emitting diode 112*a* may be configured to generate a second white light having a second color temperature. By providing a plurality of second light emitting diodes 112*a*, on the one hand, the second light intensity of the second radiated light generated by the second light emitting assembly 112 can be increased, and on the other hand, the position of each second light emitting diode 112*a* can be set to help realize a uniform distribution or other specific distributions of the second radiated light in space. In addition, the plurality of second light emitting diodes 112*a* may be connected in parallel, so that when a certain second light emitting diode 112*a* malfunctions, other second light emitting diodes 112*a* can still operate normally to ensure normal illumination as much as possible.

In some embodiments, the second light emitting diodes 112*a* may be disposed at an equal interval from each other, and uniformly distributed on the substrate to form a uniform lighting condition. In addition, the second light emitting diodes 112*a* may also be distributed in a staggered manner with respect to the first light emitting diodes 111*a*, so as to make the color temperature of the finally generated illumination light be as uniform as possible.

As shown in FIG. 1, the illumination apparatus 100 may further include a third light emitting assembly 113 configured to generate a third radiated light having a preset color and a third light intensity, and the preset color and the third light intensity may be adjustable. In some embodiments, the third light emitting assembly 113 may be configured to indicate current status information, and specifically, the current status information may reflect the current status of the illumination apparatus 100 itself, or may reflect the current status of other apparatus, device, or system, etc. that includes the illumination apparatus 100, so that a user may learn the current situation or proceed with the operation according to the indication of the third light emitting assembly 113. Different preset colors can be utilized to correspond to different current status information, and different current status information can be indicated by forming flashing and breathing light emitting effects by adjusting the third light intensity.

As shown in FIG. 1, the third light emitting assembly 113 may include a plurality of third light emitting devices 113*a*, wherein the third light emitting device 113*a* is configured to generate a chromatic light. By providing a plurality of third light emitting devices 113*a*, on the one hand, the third light intensity of the third radiated light generated by the third light emitting assembly 113 can be increased, and on the other hand, the position of each third light emitting device 113*a* can be set to help realize a uniform distribution or other specific distributions of the third radiated light in space, including helping form a specific pattern for indicating the current status information, etc. In addition, the plurality of third light emitting devices 113*a* may be connected in parallel, so that when a certain third light emitting device 113*a* malfunctions, other third light emitting devices 113*a* can still normally operate to ensure normal illumination as much as possible.

In some embodiments, the third light emitting devices 113*a* may be disposed at an equal interval from each other and uniformly distributed on the substrate to generate a uniform third radiated light. In addition, the third light emitting device 113*a* may be disposed in a staggered manner with respect to the first light emitting diode 111*a* and the second light emitting diode 112*a*, that is, the first light emitting diode 111*a* or the second light emitting diode 112*a* is adjacent to the third light emitting device 113*a*, so that the first light emitting diode 111*a*, the second light emitting diode 112*a*, and the third light emitting device 113*a* may be substantially distributed on the entire substrate, such that both the white light for illumination and the chromatic light for indicating the current status information may be substantially uniform. In some embodiments, the first light emitting diodes 111*a* have a greater distribution density than that of the third light emitting devices 113*a*, and similarly, the second light emitting diodes 112*a* also have a greater distribution density than that of the third light emitting devices 113*a*, so as to provide sufficient white light illumination; while the third light emitting assembly 113 is used to indicate the current status information, thus the third light emitting devices 113*a* therein may have a smaller distribution density to avoid excessive power consumption while implementing the indicating function.

To produce a chromatic light, lights of three colors of red, green and blue can be produced and combined in different proportions. For a single third light emitting device 113*a*, it may include at least one third light emitting diode, at least one fourth light emitting diode, and at least one fifth light emitting diode, wherein the third light emitting diode may be configured to generate a red light, the fourth light emitting diode may be configured to generate a green light, and the fifth light emitting diode may be configured to generate a blue light. By controlling proportions of respective chromatic lights generated by the respective light emitting diodes in the third light emitting device 113*a*, a chromatic light having a plurality of colors can be generated.

In order to adjust parameters of the radiated light generated by the individual light emitting assemblies in the illumination apparatus 100, corresponding signals may be provided to the individual light emitting assemblies respectively through ports, conductive cables, etc. The illumination apparatus 100 may include one or more input ports each configured to receive a respective input signal. As shown in FIG. 1, the one or more input ports may include a first input port 141, a second input port 142, and a third input port 143.

The first input port 141 may be electrically connected with the first light emitting assembly 111 and configured to receive a first power supply signal corresponding to the first light intensity. The first power supply signal may come from a power supply apparatus external to the illumination apparatus 100 or the like, as will be described in more detail later. The first light emitting assembly 111 may be configured to generate the first radiated light having the first light intensity according to the first power supply signal. In some embodiments, the first power supply signal is a first direct current signal, which may for example have a maximum level of 5V, and the level of the first direct current signal may be varied within a range to produce the required first light intensity.

Similarly, the second input port 142 can be electrically connected with the second light emitting assembly 112 and configured to receive a second power supply signal corresponding to the second light intensity. The second power supply signal may come from the power supply apparatus external to the illumination apparatus 100 or the like, as will be described in more detail later. The second light emitting assembly 112 can be configured to generate the second radiated light having the second light intensity according to the second power supply signal. In some embodiments, the second power supply signal is a second direct current signal, which may for example have a maximum level of 5V, and the level of the second direct current signal may be varied within a range to produce the required second light intensity.

The third input port 143 may be electrically connected with the third light emitting assembly 113 and configured to receive a third power supply signal corresponding to the third light intensity. The third power supply signal may come from the power supply apparatus external to the illumination apparatus 100 or the like, as will be described in more detail later. The third light emitting assembly 113 can be configured to generate the third radiated light having the third light intensity according to the third power supply signal. In some embodiments the third power supply signal is a third direct current signal, which may for example have a maximum level of 5V, and the level of the third direct current signal may be varied within a range to produce the required third light intensity.

In addition, the third input port 143 may also be configured to receive a color instruction signal. The color instruction signal may come from other device, apparatus or system, etc. connected with the illumination apparatus 100 and may be associated with a user instruction or current status, etc. The third light emitting assembly 113 may be configured to generate the third radiated light having the preset color according to the color instruction signal. In conjunction with the change of the third light intensity, the third light emitting assembly 113 can also generate various effects such as flashing and breathing lighting.

The color instruction signal may be formed according to the user instruction or the current status, etc., however, such a color instruction signal may be difficult to directly drive the third light emitting assembly 113 to generate the third radiated light. In order to enable the third light emitting assembly 113 to generate the corresponding third radiated light according to the color instruction signal, as shown in FIG. 1, the illumination apparatus 100 may further include a first controller 120 and a driver 130. The first controller 120 may be configured to receive the color instruction signal and to convert the color instruction signal into a color controlling signal, that is, the first controller 120 may parse the color instruction signal to form the color controlling signal encoded according to a preset encoding rule, for example. In some embodiments, the first controller 120 may be a Micro Control Unit (MCU). Further, the driver 130 may be electrically connected between the first controller 120 and the third light emitting assembly 113, and configured to receive the color controlling signal, convert the color controlling signal into a color driving signal, and transmit the color driving signal to the third light emitting assembly 113. The color driving signal may be designed according to a type or model of the third light emitting assembly 113 actually used, and the third light emitting assembly 113 may be directly driven by the color driving signal to generate the third radiated light having the preset color. For example, the color driving signal may include a pulse signal, a square wave signal, or the like. In some embodiments, the color driving signal may include a pulse width modulated signal, a change in the duty cycle of which can control a change in the color of the third radiated light. In some other embodiments, a high level and a low level may be used to represent 0 and 1 of a bit, respectively, the color driving signal may be a square wave signal, and a specific waveform of the square wave signal may be used to represent a plurality of bits corresponding to the preset color.

In practice, the color instruction signal, the color controlling signal, the color driving signal, etc. may suffer from other interferences in the environment, resulting in an undesired change of their duty cycle and thus in a color error of the generated third radiated light. In order to solve the above problem, the first controller 120 is further configured to periodically control, at a preset frequency, the driver 130 to drive the third light emitting assembly 113. Then, in each driving, the color driving signal received by the third light emitting assembly 113 is refreshed to avoid that the previous interference continuously affect the color of the third radiated light. In some embodiments, the first controller 120 may periodically receive the color instruction signal and continue to control the driver 130 to drive the third light emitting assembly 113. In some other embodiments, the first controller 120 may periodically generate the color controlling signal according to the color instruction signal and continue to control the driver 130 to drive the third light emitting assembly 113. In still other embodiments, the first controller 120 may control the driver 130 to periodically generate the color driving signal according to the color controlling signal, to drive the third light emitting assembly 113. The preset frequency may be set to be greater than a frequency corresponding to a time period for the persistence of vision so that a possible color error of the third radiated light can be ignored.

As shown in FIG. 1, the illumination apparatus 100 may further include an output port 150 electrically connected with at least one of the one or more input ports, and configured to output an output signal, wherein the output signal may include at least a portion of an input signal received by an input port electrically connected with the output port 150. By providing the output port 150, at least a portion of the input signal received by the illumination apparatus 100 can be relayed out for providing to other device, apparatus, or system, etc., e.g., to at least one input port of another illumination apparatus, to facilitate signal transmission and configuration of the illumination apparatus 100.

In some embodiments, the third input port 143 may be electrically connected with the output port 150, and the output port 150 may be configured to output the color instruction signal received by the third input port 143 as an output signal. When the output port 150 is connected to a third input port of another illumination apparatus, the color instruction signal can be directly transmitted through the illumination apparatuses, so that the plurality of illumination apparatuses generate the third radiated light of the same color.

In addition, when it is needed to assemble a plurality of illumination apparatuses, corresponding electrical connections are needed according to the input port and the output port of the illumination apparatus only, without the need of considering circuit installation error possibly caused by change of left and right directions of the illumination apparatus and the like, thereby facilitating to simplify the process and to reduce the assembly cost.

Since the first power supply signal, the second power supply signal, and the third power supply signal all may be direct current signals and may be conveniently provided to the corresponding light emitting assembly through a power supply apparatus described below and the like, the output port 150 may not relay the first power supply signal, the second power supply signal, and the third power supply signal, but the power supply apparatus 200 may directly supply the corresponding first power supply signal, the second power supply signal, and the third power supply signal to the plurality of illumination apparatuses 100. Of course, in other embodiments, if related circuits in the illumination apparatus 100 and the power supply apparatus are different, at least one of the first power supply signal, the second power supply signal, and the third power supply signal may be relayed by the output port 150 as needed.

As shown in FIG. 1, in some embodiments, the first controller 120 is further configured to relay the color instruction signal to the output port 150, that is, the color instruction signal received by the third input port 143 will flow to the output port 150 through the first controller 120. In some embodiments, the first controller 120 relays the color instruction signal directly without any processing, and in some other embodiments, the first controller 120 may also perform some processing on the color instruction signal and provide it to the output port 150 for output.

Figure 2:
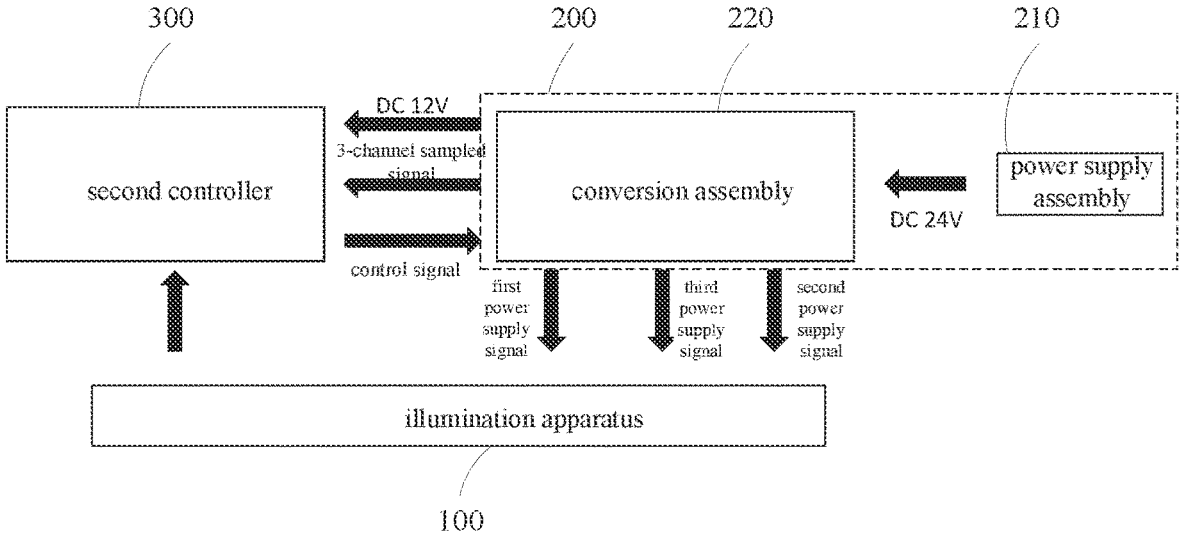
FIG. 2 shows a structure schematic diagram of an illumination system according to an exemplary embodiment of the present disclosure.

The present disclosure also proposes an illumination system. As shown in FIG. 2, the illumination system comprises an illumination apparatus 100, a power supply apparatus 200, and a second controller 300.

The illumination apparatus 100 in the illumination system may be the illumination apparatus in any of the above embodiments, and will not be described herein again. The power supply apparatus 200 may be electrically connected with the illumination apparatus 100 and configured to provide a power supply signal to the illumination apparatus 100.

In some embodiments, the power supply apparatus 200 may include a power supply assembly 210 and a conversion assembly 220. The power supply assembly 210 may be configured to generate a direct current power supply signal having a preset level, and the converting assembly 220 may be electrically connected with the power supply assembly 210 and configured to convert the direct current power supply signal into a first power supply signal for supplying the first light emitting assembly 111, a second power supply signal for supplying the second light emitting assembly 112, and a third power supply signal for supplying the third light emitting assembly 113. For example, in a specific example shown in FIG. 2, the level of the direct current power supply signal may be 24V, and the first power supply signal, the second power supply signal and the third power supply signal are generally less than 24V, and are adjustable in a range of 0-5V, for example.

The second controller 300 may be electrically connected with the illumination apparatus 100 and the power supply apparatus 200, and configured to adjust at least one of the first light intensity, the second light intensity, the third light intensity, and the preset color. As shown in FIG. 2, the second controller 300 may generate a control signal and transmit the control signal to the conversion assembly 220, to control on/off and level values of the various power supply signals (including the first power supply signal, the second power supply signal, the third power supply signal, and etc.) output by the conversion assembly 200.

In some embodiments, the second controller 300 may be further communicatively connected with an upper-level machine (not shown in the figures) such as other apparatus, device, or system, and configured to receive a command signal and to adjust at least one of the first light intensity, the second light intensity, the third light intensity, and the preset color according to the command signal.

In some embodiments, the second controller may be communicatively connected with a sensing apparatus (not shown in the figures) and configured to receive a sensing signal from the sensing apparatus and to adjust at least one of the first light intensity, the second light intensity, the third light intensity, and the preset color according to the sensing signal. Specifically, the sensing signal may be related to at least one of the light intensity, color temperature and color of the radiated light generated by the illumination apparatus.

The conversion assembly 220 can also convert the direct current power supply signal into a control power supply signal for supplying the second controller 300, to provide a power supply required to support the operation of the second controller 300. In a specific example shown in FIG. 2, the control power supply signal may be a direct current signal of 12V.

The second controller 300 may also participate in monitoring the power supply state of the power supply apparatus 200. Specifically, the conversion assembly 220 may further include a sampling circuit configured to sample the first power supply signal, the second power supply signal, and the third power supply signal to generate a sampled signal (a three-channel sampled signal shown in FIG. 2, wherein one channel corresponds to a power supply signal supplied to one light emitting assembly), and to transmit the sampled signal to the second controller 300. In some embodiments, the sampling circuit may include an analog-to-digital conversion circuit or the like, wherein the analog-to-digital conversion circuit may convert the first power supply signal, the second power supply signal, and the third power supply signal in an analog form to a digital form to be subsequently analyzed and processed by the second controller 300.

Further, the second controller 300 may be configured to control the conversion assembly 220 to control at least one of the first power supply signal, the second power supply signal, and the third power supply signal according to the sampled signal. For example, when the second controller 300 determines according to the fed-back sampled signal that, the currently output first power supply signal, second power supply signal or third power supply signal does not meet the requirement corresponding to the control signal, the conversion assembly 220 may be controlled to increase or decrease the first power supply signal, the second power supply signal or the third power supply signal accordingly. In addition, when the second controller 300 determines according to the sampled signal that the adjustment of the first power supply signal, the second power supply signal, or the third power supply signal has already exceeded or is about to exceed a preset adjustment range, it may further generate a control signal to suspend the adjustment of the first power supply signal, the second power supply signal, or the third power supply signal, or directly cut off the first power supply signal, the second power supply signal, or the third power supply signal, etc., so as to protect the illumination system.

Figure 3:
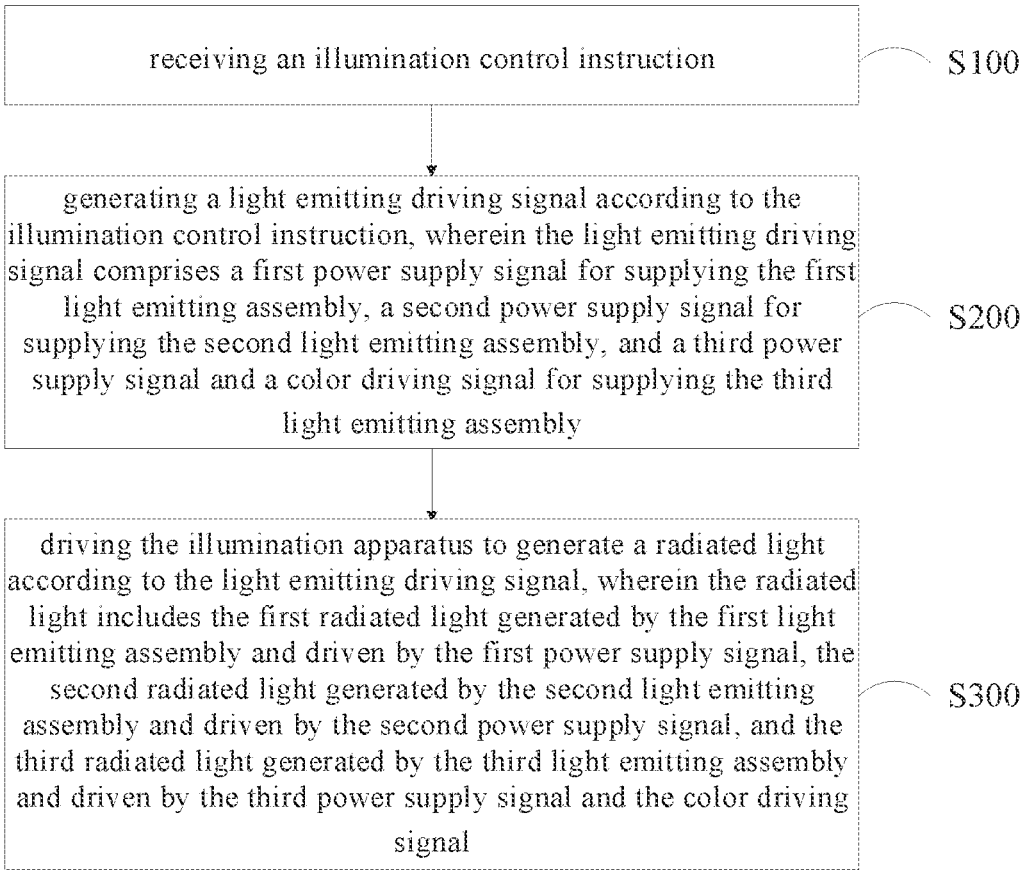
FIG. 3 shows a flowchart diagram of an illumination control method according to an exemplary embodiment of the present disclosure.

According to an exemplary embodiment of the present disclosure, an illumination control method is also proposed. The method is used for controlling the illumination apparatus in any of the above embodiments. As shown in FIG. 3, the method may include: step S100 of receiving an illumination control instruction.

The illumination control instruction may be received by the second controller 300 directly from the upper-level machine, or may be generated by performing a certain processing on an instruction from the upper-level machine, or may be generated by the second controller 300 according to a sensing signal from a sensing apparatus, and so on.

As shown in FIG. 3, the method may further include: step S200 of generating a light emitting driving signal according to the illumination control instruction, wherein the light emitting driving signal includes a first power supply signal for supplying the first light emitting assembly, a second power supply signal for supplying the second light emitting assembly, and a third power supply signal and a color driving signal for supplying the third light emitting assembly.

Specifically, the first power supply signal, the second power supply signal, and the third power supply signal may be generated by controlling the power supply apparatus 200 by the second controller 300 according to the illumination control instruction, and output by the power supply apparatus 200 to the respective first light emitting assembly 111, the second light emitting assembly 112, and the third light emitting assembly 113 in the illumination apparatus 100. The color driving signal may be generated from the color instruction signal as described above, and the color instruction signal may be a portion of, or generated by, the illumination control instruction.

As shown in FIG. 3, the method may further include: a step S300 of driving the illumination apparatus to generate the radiated light according to the light emitting driving signal, wherein the radiated light includes the first radiated light generated by the first light emitting assembly and driven by the first power supply signal, the second radiated light generated by the second light emitting assembly and driven by the second power supply signal, and the third radiated light generated by the third light emitting assembly and driven by the third power supply signal and the color driving signal.

The first power supply signal, the second power supply signal, the third power supply signal, and the color driving signal may be adjusted through the illumination control instruction, to vary an illumination parameter of the first, second, and third radiated lights so as to meet desired illumination or indication requirements.

Further, the method may further include: accumulating a driving duration of the light emitting driving signal; and when the driving duration is longer than or equal to a preset duration, recontrolling the illumination apparatus to generate the radiated light according to the illumination control instruction.

That is, the illumination apparatus may be periodically driven as described above to avoid that interferences with the signal cause the illumination parameters of the radiated light generated by the illumination apparatus to be in an error state for a long time.

In some embodiments, the method may further include: acquiring a color instruction signal according to the illumination control instruction; and relaying the color instruction signal to another illumination apparatus; wherein the color instruction signal corresponds to the color driving signal.

That is, the color instruction signal may be directly relayed to another illumination apparatus, so that a plurality of illumination apparatuses may generate the radiated light of same color, facilitating the installation of the plurality of illumination apparatuses.

To facilitate a user to monitor the current state of the illumination apparatus, the method may further include: generating and outputting a feedback signal according to the current state of the illumination apparatus.

The user can learn the current state of the illumination apparatus according to the output feedback signal. For example, when the illumination apparatus is in a standby state, the third radiated light in blue may be generated; when the illumination apparatus is in a fault state, the third radiated light in red may be generated to prompt the user for service.

In some embodiments, to improve device security, the illumination control instruction may also be checked after it is received. Specifically, the method may further include: judging whether the illumination control instruction coincides with a preset check rule; when the illumination control instruction does not coincide with the preset check rule, generating and outputting an error signal; and when the illumination control instruction coincides with the preset check rule, generating the light emitting driving signal according to the illumination control instruction, or driving the illumination apparatus to generate the radiated light according to the light emitting driving signal.

In some embodiments, prior to receiving the illumination control instruction, for example, when the illumination apparatus is turned on, the method may further include: acquiring a default illumination control instruction; and controlling the illumination apparatus to generate a default radiated light according to the default illumination control instruction.

In this way, the user can determine that the illumination apparatus is currently in an on state etc. according to the generated default radiated light.

The terms "front," "back," "top," "bottom," "over," "under" and the like, as used herein, if any, are used for descriptive purposes and not necessarily for describing permanent relative positions. It should be understood that such terms are interchangeable under appropriate circumstances such that the embodiments of the disclosure described herein are, for example, capable of operation in other orientations than those illustrated or otherwise described herein.

The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the preceding technical field, background, summary or detailed description.

The term "substantially", as used herein, is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

In addition, the foregoing description may refer to elements or nodes or features being "connected" or "coupled" together. As used herein, unless expressly stated otherwise, "connected" means that one element/node/feature is electrically, mechanically, logically or otherwise joined to (or communicates with) another element/node/feature. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

In addition, certain terminology, such as the terms "first", "second" and the like, may also be used herein for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, integers, steps, operations, elements, and/or components, but do not preclude the presence or addition of one or more other features, integers, steps, operations, elements, components, and/or groups thereof.

In this disclosure, the term "provide" is intended in a broad sense to encompass all ways of obtaining an object, thus the expression "providing an object" includes but is not limited to "purchasing", "preparing/manufacturing", "disposing/arranging", "installing/assembling", and/or "ordering" the object, or the like.

Furthermore, those skilled in the art will recognize that boundaries between the above described operations are merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments. However, other modifications, variations and alternatives are also possible. The description and drawings are, accordingly, to be regarded in an illustrative rather than in a restrictive sense.

Although some specific embodiments of the present disclosure have been described in detail with examples, it should be understood by a person skilled in the art that the above examples are only intended to be illustrative but not to limit the scope of the present disclosure. The embodiments disclosed herein can be combined arbitrarily with each other, without departing from the scope and spirit of the present disclosure. It should be understood by a person skilled in the art that the above embodiments can be modified without departing from the scope and spirit of the present disclosure. The scope of the present disclosure is defined by the attached claims.

What is claimed is:

1. An illumination system, comprising:

an illumination apparatus; and a controller coupled to the illumination apparatus, configured to:

receive an illumination control instruction;

based on the reception, generate a light emitting driving signal, wherein the illumination apparatus is configured to:

generate a radiated light according to the light emitting driving signal, wherein the illumination apparatus comprises:

a first light emitting assembly configured to generate a first radiated light having a first color temperature and a first light intensity, wherein the first light intensity is adjustable;

a second light emitting assembly configured to generate a second radiated light having a second color temperature and a second light intensity, wherein the second light intensity is adjustable and the second color temperature is lower than the first color temperature; and a third light emitting assembly configured to generate a third radiated light having a preset color and a third light intensity, wherein the preset color and the third light intensity are adjustable, wherein a color temperature of the radiated light generated by the illumination apparatus is adjusted by adjusting at least one of the first light intensity and the second light intensity, wherein the illumination apparatus is configured to:

accumulate a driving duration of the light emitting driving signal;

determine that the driving duration is longer than or equal to a preset duration; and based on the determination, refresh the radiated light according to the illumination control instruction.

2. The illumination system according to claim 1, further comprising:

one or more input ports configured to receive a respective input signal; and an output port electrically connected with at least one of the one or more input ports and configured to output an output signal, wherein the output signal comprises at least a portion of a respective input signal.

3. The illumination system according to claim 2, wherein the output port is configured to be electrically connected with at least one input port of another illumination apparatus.

4. The illumination system according to claim 2, wherein the one or more input ports comprise a third input port electrically connected with the output port and configured to receive a color instruction signal corresponding to the preset color; and the output port is configured to output the color instruction signal.

5. The illumination system according to claim 4, wherein the third input port is further electrically connected with the third light emitting assembly; and the third light emitting assembly is configured to generate the third radiated light having the preset color according to the color instruction signal.

6. The illumination system according to claim 5, wherein the third input port is further configured to receive a third power supply signal corresponding to the third light intensity; and the third light emitting assembly is configured to generate the third radiated light having the third light intensity according to the third power supply signal.

7. The illumination system according to claim 4, further comprising a first controller electrically connected with the third input port and configured to:

receive the color instruction signal;

convert the color instruction signal into a color controlling signal; and relay the color instruction signal to the output port; and a driver electrically connected between the first controller and the third light emitting assembly and configured to:

receive the color controlling signal;

convert the color controlling signal into a color driving signal; and transmit the color driving signal to the third light emitting assembly.

8. The illumination system according to claim 2, wherein the one or more input ports comprise a first input port electrically connected with the first light emitting assembly and configured to receive a first power supply signal corresponding to the first light intensity;

the first light emitting assembly is configured to generate the first radiated light having the first light intensity according to the first power supply signal.

9. The illumination system according to claim 2, wherein the one or more input ports comprise a second input port electrically connected with the second light emitting assembly and configured to receive a second power supply signal corresponding to the second light intensity;

the second light emitting assembly is configured to generate the second radiated light having the second light intensity according to the second power supply signal.

10. The illumination system according to claim 1, wherein the first light emitting assembly comprises a plurality of first light emitting diodes connected in parallel configured to generate a first white light having the first color temperature;

the second light emitting assembly comprises a plurality of second light emitting diodes connected in parallel configured to generate a second white light having the second color temperature; and the third light emitting assembly comprises a plurality of third light emitting devices connected in parallel configured to generate a chromatic light.

11. The illumination system according to claim 1, wherein the first light emitting assembly and the second light emitting assembly are configured for illumination; and the third light emitting assembly is configured to indicate current status information.

12. The illumination system according to claim 1, further comprising a power supply apparatus electrically connected with the controller and configured to provide a power supply signal to the illumination apparatus, wherein the controller is further configured to adjust at least one of the first light intensity, the second light intensity, the third light intensity, and the preset color.

13. The illumination system according to claim 12, wherein the controller is configured to adjust at least one of the first light intensity, the second light intensity, the third light intensity, and the preset color according to the illumination control instruction.

14. The system according to claim 12, wherein the power supply apparatus comprises:

a power supply assembly configured to generate a direct current power supply signal having a preset level; and a conversion assembly electrically connected with the power supply assembly and configured to convert the direct current power supply signal into a first power supply signal for supplying the first light emitting assembly, a second power supply signal for supplying the second light emitting assembly, a third power supply signal for supplying the third light emitting assembly, and a control power supply signal for supplying the controller.

15. The illumination system according to claim 12, wherein the illumination control instruction corresponds to a sensing signal, the controller is further configured to:

adjust at least one of the first light intensity, the second light intensity, the third light intensity, and the preset color according to the sensing signal, wherein the sensing signal is related to at least one of light intensity, color temperature and color of the radiated light generated by the illumination apparatus.

16. A method for operating an illumination system, comprising:

receiving an illumination control instruction;

generating a light emitting driving signal according to the illumination control instruction, wherein the light emitting driving signal comprises a first power supply signal for a first light emitting assembly, a second power supply signal for a second light emitting assembly, and a third power supply signal and a color driving signal for a third light emitting assembly;

generating a radiated light according to the light emitting driving signal, wherein the radiated light comprises a first radiated light generated by the first light emitting assembly driven by the first power supply signal, a second radiated light generated by the second light emitting assembly driven by the second power supply signal, and a third radiated light generated by the third light emitting assembly driven by the third power supply signal and the color driving signal;

accumulating a driving duration of the light emitting driving signal;

determining that the driving duration is longer than or equal to a preset duration; and based on the determination, refreshing the radiated light according to the illumination control instruction.

17. The method according to claim 16, further comprising:

acquiring a color instruction signal according to the illumination control instruction; and relaying the color instruction signal to another illumination apparatus, wherein the color instruction signal corresponds to the color driving signal.

18. The method according to claim 16, further comprising:

generating a feedback signal according to a current state of an illumination apparatus of the illumination system.

19. The method according to claim 18, wherein prior to receiving the illumination control instruction, the method further comprises:

acquiring a default illumination control instruction; and controlling the illumination apparatus to generate a default radiated light according to the default illumination control instruction.

20. The method according to claim 16, wherein after receiving the illumination control instruction, the method further comprises:

determining that the illumination control instruction coincides with a preset check rule; and generating the light emitting driving signal according to the illumination control instruction.

* * * * *